United States Patent [19]

Nielsen et al.

[11] 4,169,784

[45] Oct. 2, 1979

[54] CATALYTIC CRACKING PROCESS USING A PASSIVATION AGENT AND AN OXIDATION PROMOTER

[75] Inventors: Richard H. Nielsen; Glenn H. Dale, both of Bartlesville, Okla.

[73] Assignee: Phillips Petroleum Company, Bartlesville, Okla.

[21] Appl. No.: 933,939

[22] Filed: Aug. 15, 1978

[51] Int. Cl.[2] ..... C10G 11/04; C10G 9/16; B01J 8/24; B01J 23/56

[52] U.S. Cl. ..... 208/113; 208/52 CT; 208/120; 208/121; 208/251 R; 252/416; 252/419; 252/455 Z

[58] Field of Search ..... 208/52 CT, 113–123; 252/416–419

[56] References Cited

U.S. PATENT DOCUMENTS

| | | | |
|---|---|---|---|
| 2,129,693 | 9/1938 | Houdry | 208/119 |
| 2,436,927 | 3/1948 | Kassell | 252/417 |
| 2,901,419 | 8/1959 | Brill | 208/119 |
| 3,136,713 | 6/1964 | Miale et al. | 208/113 |
| 3,364,136 | 1/1968 | Chen et al. | 208/120 |
| 3,650,990 | 3/1972 | Frilette et al. | 252/455 Z |
| 3,696,025 | 10/1972 | Chessmore et al. | 208/113 |
| 3,711,422 | 1/1973 | Johnson et al. | 252/414 |
| 4,025,458 | 5/1977 | McKay | 252/416 |
| 4,036,740 | 7/1977 | Readal et al. | 208/120 |
| 4,040,945 | 8/1977 | McKinney et al. | 208/113 |

*Primary Examiner*—Delbert E. Gantz
*Assistant Examiner*—G. E. Schmitkons

[57] ABSTRACT

A method for the simultaneous use of a metals passivation agent and an oxidation promoter in a catalytic cracking system. The oxidation promoter charge is increased an effective amount upon charging the passivation agent at an excessive rate to thereby allow the benefits of both agents to be realized.

13 Claims, No Drawings

CATALYTIC CRACKING PROCESS USING A PASSIVATION AGENT AND AN OXIDATION PROMOTER

BACKGROUND OF THE INVENTION

This invention relates to the cracking of hydrocarbons. In another aspect, this invention relates to a catalytic cracking process which uses a passivation agent and an oxidation promoter simultaneously. Still another aspect of this invention is a catalyst cracking process wherein the afterburning is controlled. Still another aspect of this invention relates to the use of a metals passivation agent in a cracking unit which also uses a catalyst containing a combustion promoter without encountering regenerator afterburning problems. In still another aspect, this invention relates to a cracking catalyst process which uses a passivation agent and an oxidation promoter simultaneously wherein the charge rate of the oxidation promoter is increased an effective amount at about the same time the passivation agent is charged to the reactor at an excessive rate.

It is well known that in the catalytic cracking process for converting gas oil, and the like to gasoline that heavy metals such as nickel and vanadium in the feedstock deposit on the catalyst, imparing its activity for converting heavier hydrocarbons to gasoline while enhancing its activity for converting hydrocarbons to coke and hydrogen, a most undesirable result.

Recently it has been found that the addition of various antimony compounds or other agents to the catalyst can passivate the contaminating metals and restore the catalyst to near its original activity. The passivation compound can be added directly to the catalyst or can be continuously supplied to the cracking unit, for example, by incorporating the agent in the hydrocarbon feed to the unit. The latter method is generally preferred. Examples of suitable antimony passivating agents are disclosed in U.S. Pat. No. 3,711,422 and 4,025,458, which are incorporated by reference herein.

Another well-known group of agents useful in catalytic cracking are the combustion promoters. These include many metals in Groups IB, IIB, IVB, VA, VB, VIB, VIIB, and VIII and compounds thereof. Examples of appropriate agents are disclosed in U.S. Pat. Nos. 3,136,713, 3,364,136, and 4,036,740. These agents, which are generally incorporated into the catalyst before use, promote the combustion of CO in the catalyst regenerator and thereby help prevent or minimize the problem of afterburning which is the combustion of CO in the dilute phase of the regenerator to thereby cause undesirable high temperatures in the upper part of the regenerator vessel, including the cyclones.

Problems have been encountered, however, when a passivation agent and an oxidation promoter are used simultaneously in a catalytic cracker. It has been found that when a passivation agent is used in a cracking unit in which the catalyst contains a combustion promoter the performance of the promoter is impaired and the tendency toward regenerator afterburning increased. This effect is most pronounced when the passivation agent is initially charged to a cracking unit. During this period the passivation agent is charged at a high rate, generally two to 100 times the normal maintenance rate, in order to build up the concentration of passivation agent on the catalyst to an effective level. During the latter part of such a buildup period and for some time thereafter, the activity of the promoter is reduced and difficulty with afterburning is encountered.

Accordingly, it is an object of this invention to provide an improved cracking process using a passivating agent and an oxidation promoter simultaneously.

Another object of this invention is to provide a novel process for controlling and reducing the afterburning in a cracking process caused by a reduction in the oxidation promoter's activity due to the presence of a metal passivation agent while maintaining an essentially constant regenerator air flow rate.

Yet a further object of this invention is to provide a cracking process which uses both a passivation agent and an oxidation promoter effectively by overcoming the problems of using the two agents simultaneously.

Other objects, aspects, and the several advantages of this invention will be apparent to those skilled in the art upon a study of this disclosure and the appended claims.

SUMMARY OF THE INVENTION

This invention relates to a method for the simultaneous use of a metals passivation agent and an oxidation promoter in a catalytic cracking system. The charge rate of the oxidation promoter is increased an effective amount at the approximate time the passivation agent is charged at an excessive rate to the reactor to thereby allow the benefits of both agents to be realized. The charge rate of the oxidation promoter can be increased shortly before and during the time periods when the passivating agent is being charged to the reactor at an excessive rate, or during and shortly after the time period the charge rate of the passivation agent is excessive. In either case, the charge rate of the oxidation promotor is increased at about the same time, contemporaneously, with the charging of the passivation agent at an excessive rate to thereby offset the tendency for the passivation agent to deactivate the oxidation promoter. The process, therefore, allows one to control and reduce the afterburning prompted by the excessive charge of passivation agent.

An embodiment of this invention, therefore, is the increase of the charge rate of the oxidation promoter an effective amount and for an effective period of time at about the same time the passivation agent is charged at an excessive rate to the reactor for a period of time.

Another embodiment of the invention pertains to the increase of the oxidation promoter charge rate shortly before the period that the passivation agent is charged to the reactor at an excessive rate and maintained at the increased rate during the period of excessive passivation agent charge.

In another embodiment, the oxidation promoter charge is increased during the period of excessive passivation agent charge and maintained at the increased rate for a short time after the period of excessive passivation agent charge terminates.

Generally, the oxidation promoter charge rate can be increased by about 25 to 500 percent when the excessive passivation agent charge is about 200 to 10,000 percent greater than the normal rate.

This invention is especially applicable to the situation when the passivation agent is charged an excessive rate for a period of time in order to build up an inventory of active passivation agent in the system, e.g., the initial charge of the metals passivation agent into the cracking system.

DETAILED DESCRIPTION OF THE INVENTION

The problem of using a passivating agent and an oxidation promoter simultaneously in a catalytic cracking process resides in the impairment of the performance of the promoter due to the presence of the passivation agent. Impairing the activity of the promoter increases the tendency toward regenerator afterburning, the combustion of CO to $CO_2$ in the dilute phase of the regenerator, which thereby causes undesirable high temperatures in the upper part of the regenerator vessel, including the cyclones. It has now been discovered, however, that a metals passivation agent can be used in a cracking unit which is also using a catalyst containing a CO combustion promoter (oxidation promoter) without encountering regenerator afterburning problems by increasing the charge rate of the oxidation promoter an effective amount and for an effective period of time at about the same time the passivation agent is charged at an excessive rate to the reactor. This allows the benefits of both agents to be realized by offsetting the tendency of the passivation agent to deactivate the oxidation promoter.

With regard to the invention, an excessive passivation agent charge rate is a rate greater than that required to maintain the constant, nondeclining passivation agent level in the catalyst bed. The passivation agent is charged at an excessive rate whenever it is desired to build up the passivation agent level from a lower level, e.g., when the metals passivation agent is first inaugurated into the system. The excessive charge rate of the passivating agent can be from about 200 to about 10,000 percent greater than the normal charge rate, that rate required to maintain a constant, nondeclining passivation agent level in the bed catalyst.

The charge rate of the oxidation promoter is increased shortly before and maintained during, or increased during and maintained until shortly after the period of time in which the passivating agent is charged at an excessive rate. The oxidation promoter charge rate is increased an effective amount, an amount sufficient to offset the tendency for the passivation agent to deactivate the oxidation promoter and thereby increase the tendency toward regenerator afterburning. Generally, the charging rate of the oxidation promoter can be increased by about 25 to about 500 percent shortly before and maintained during, or increased during and maintained until shortly after the periods when the passivation agent is being charged to the reactor at an excessive rate, which is generally about 200 to about 10,000 percent greater than the normal rate with the normal rate for an antimony-based catalyst being about one pound of antimony for each two pounds of nickel plus vanadium in the feed. The charging rate of the oxidation promoter is reduced to normal upon reducing the rate of addition of passivating agent to normal or shortly thereafter.

The cracking process to which the novel process of the instant invention applies can be any cracking process known in the art. Such a cracking process generally comprises a cracking zone in which hydrocarbons and a cracking catalyst are contacted under cracking conditions to form a cracked hydrocarbon mixture. After separation from the cracked product, the cracking catalyst is regenerated continuously or batchwise by contacting the catalyst with a free oxygen-containing gas, perferably air, in order to burn off the coke and regenerate the catalyst. Most of the cracking operations use a cracking-regeneration system comprising a cracking zone and a regeneration zone in which loop system the catalyst is continuously circulated. These systems are also referred to as cracking-regeneration loops in the following. The cracking catalyst leaving the cracking zone before being introduced into the regeneration zone is generally stripped to remove entrained hydrocarbons. This is generally done by steam injection.

The catalyst used in the catalytic hydrocarbon cracking process of this invention can be any known cracking catalyst. More specifically, this catalytic cracking material can be any of those cracking catalysts conventionally employed in the catalytic cracking of hydrocarbons boiling above 400° F. (204° C.) for the production of gasoline, motor fuel, blending components, and light distillates. These conventional cracking catalysts generally contain silica or silica-alumina. Such materials are frequently associated with zeolitic materials. These zeolitic materials can be naturally occurring or they can be produced by conventional ion exchange methods such as to provide metallic ions which improve the activity of the catalyst. Zeolite-modified silica-alumina cracking catalysts are particularly applicable in this invention. Examples of cracking catalysts that can be used in accordance with this invention include hydrocarbon cracking catalysts obtained by admixing an inorganic oxide gel with an alumino silicate and alumino silicate compositions which are strongly acidic as a result of treatment with the fluid medium containing at least one rare earth cation and hydrogen ion, or ions capable of conversion to a hydrogen ion. Other cracking catalysts that can be used include crystalline, alumino silicate zeolites having the mordenite crystal structure. The fresh cracking catalyst material will generally be in particulate form having a particle size principally within the range of about 10 to about 200 microns. The pore volume of such a fresh cracking catalyst before steam aging thereof will generally be in the range of about 0.1 to about 1 cc/g. The surface area of such fresh cracking catalyst material generally will be in the area of about 50 to about 500 $m^2/g$.

Typical operating conditions, both for the cracking zone and for the regeneration zone, are within the ranges shown in the following table:

| | |
|---|---|
| | Cracking Zone: |
| Temperature: | 800° F. to 1200° F. (427–649° C.) |
| Pressure: | Subatmospheric to 3,000 psig |
| Catalyst/Oil Ratio: | 3/1 to 30/1, by weight |
| | Regeneration Zone: |
| Temperature: | 1000° F. to 1500° F. (538–816° C.) |
| Pressure: | Subatmospheric to 3,000 psig |
| Air (60° F., 1 atm): | 100–250 $ft^3$/lb coke (6.2–15.6 $m^3$/kg coke) |

the hydrocarbon feedstocks that are catalytically cracked in the process of this invention are oil feedstocks which are conventionally utilized in catalytic cracking processes to produce gasoline and light distillate fractions from heavier hydrocarbon feedstocks. These feedstocks generally have an initial boiling point above about 400° F. (204° C.) and include such fluids as gas oils, fuel oils, topped crudes, deasphalted oils, shale oils, oils from tar sands, oils from coal, and the like. By "topped crude" are meant those oils which are obtained as the bottoms of a crude oil fractionator.

The feedstocks will also normally contain one or more of the contaminating metals nickel, vanadium and iron. The concentration of these metals individually will normally be in the range of a few tenths of a ppm to a few hundred ppm, based on the feedstock used. The total content of those contaminating metals in the feedstock can be as high as about 0.1 percent.

The passivation agents to which this invention is applicable can be any passivation agent known in the art, with passivation agents comprising antimony compounds being preferred. Examples of suitable anitmony passivating agents are disclosed in U.S. Pat. Nos. 3,711,422 and 4,025,458.

The combustion promoters applicable to the instant invention are any of the combustion promoters well known in the art. These usually include many of the metals in Groups IB, IIB, IVB, VA, VB, VIB, VIIB, and VIII and compounds thereof. Examples of suitable agents are disclosed in U.S. Pat. Nos. 3,136,713; 3,364,136; and 4,036,740, which patents are herein incorporated by reference.

It is preferred to introduce the passivation agent into the reactor by way of the hydrocarbon feedstream, but, any feasible means of introducing the agent into the cracking system would be appropriate, for example, the passivation agent can be introduced via the catalyst or steam injected into the reaction zone. In using an antimony-based passivation agent, e.g., such as those disclosed in U.S. Pat. No. 4,025,458, which patent is herein incorporated by reference, once an effective concentration has been built up on the catalyst, a normal maintenance dosage, a charge rate which maintains a constant, nondeclining antimony level in the bed catalyst, would be a rate that would introduce antimony equal to about 50 percent by weight per the nickel plus vanadium entering the reactor in feedstock. A charge rate greater than the normal maintenance rate, e.g., when the metals passivating agent is first inaugurated into the system, would qualify as an excessive charge rate of the passivating agent.

The oxidation promoter, or CO combustion promoter, in general can be charged by any of a combination of methods which are well known in the art. Examples of some appropriate methods of adding the promoter to the cracking system are by incorporating the promoter into the makeup catalyst or adding the promoter as a separate stream injected into the regenerator via the spent catalyst stream or the regeneration air stream. The promoter can also be added to the reactor in a separate stream or in combination with any stream added to the reactor. Co-addition of the oxidation promoter and the metals passivation agent would also be appropriate.

Usage rate for the oxidation promoter varies with the particular passivation agent and catalyst base used, but, generally ranges from about 0.01 to 10 weight percent of the catalyst.

Although the invention has its greatest utility when a metals passivation agent is initially charged to the reactor, the inveniton is also useful when substantial fresh catalyst makeup is required or when a substantial increase in metals content of the feed is taking place thereby requiring an excessive charge rate of the passivation agent.

The following example illustrates the problem which the instant invention solves. The example is not intended to limit the invention in any way and is only given for illustration.

EXAMPLE

A riser-type cat cracker was charging about 14,100 barrels/day of gas oil containing about 0.3 ppm Ni and 0.4 ppm V using a zeolitic catalyst containing approximately 1 ppm Pt as an oxidation promoter. Before addition of a passivation agent typical conditions were: 646° F. preheat temperature, 978° F. riser exit temperature, 1250° F. regenerator temperature, 81.7 percent conversion, 83 percent selectivity to gasoline, 4.3 percent coke with no indication of regenerator afterburning. Injection of Vanlube 622, a hydrocarbon oil containing 10.9 weight percent antimony, 9.05 weight percent phosphorus, and 19.4 weight percent sulfur (as disclosed in U.S. Pat. No. 4,025,458) was begun at a rate equivalent to 2.0 lbs/hr of antimony for two days during which time the antimony on the catalyst increased from essentially zero to 270 ppm. Difficulty with afterburning was encountered with cyclone temperatures sometimes rising to more than 100° F. above the regenerator bed temperature of about 1250° F. It was found that afterburning could be alleviated by increasing regenerator air rate to raise the oxygen content of the flue gas from about three percent to at least four percent. Antimony addition rate was then dropped to 0.06 lb/hr for five days; during this period no difficulty was encountered with afterburning. Next the antimony addition rate was increased to 0.6 lb/hr for two days, increasing the antimony content of the system catalyst to about 600 ppm. Again difficulty was encountered with afterburning. Finally, antimony addition rate was dropped back to 0.06 lb/hr and no more difficulty was encountered with afterburning. During the entire period the makeup rate of fresh catalyst containing combustion promoter was 1.5 tons/day, equivalent to a daily makeup of nearly two percent of the system catalyst. The buildup of antimony on the system catalyst caused a reduction of coke yield from 4.3 percent to 4.0 percent and a drop in hydrogen production from 36.1 to 33.1 SCF/bbl of fresh feed.

By increasing the charge rate of the oxidation promoter an effective amount, the problems encountered with afterburning upon charging the passivation agent at an excessive rate would be alleviated without increasing regenerator air rate.

Reasonable variations and modifications are possible within the scope of the foregoing disclosure and the appended claims to the invention.

We claim:

1. A catalytic cracking process which uses a metals passivation agent and an oxidation promoter simultaneously wherein at about the same time the passivation agent is charged at an excessive rate to a reactor for a period of time the charge rate of the oxidation promoter is increased an effective amount and for an effective period of time to thereby allow the benefits of both agents to be realized.

2. A process in accordance with claim 1 wherein said oxidation promoter charge rate is increased shortly before and maintained at said increased rate during the period that the passivation agent is charged to the reactor at an excessive rate.

3. A process in accordance with claim 1 wherein said oxidation promoter charge rate is increased during and maintained at said increased rate for a short time after the period that the passivation agent is charged to the reactor at an excessive rate.

4. A process in accordance with claim 1 wherein said period of time in which the passivation agent is being charged to the reactor at an excessive rate is the period when the passivation agent is initially charged to the reactor.

5. A process in accordance with claim 1 wherein said oxidation promoter charge rate is increased by about 25 to 500 percent when the passivating agent is charged to the reactor at about 200 to 10,000 percent greater than normal rate.

6. A process in accordance with claim 1 wherein said passivation agent is an antimony compound.

7. A process in accordance with claim 1 wherein said oxidation promoter is charged to a regenerator in the catalytic cracking system.

8. A process in accordance with claim 1 wherein said oxidation promoter is charged directly to the reactor.

9. A cracking process which comprises:

(a) contacting a hydrocarbon feedstock with a cracking catalyst under cracking conditions in a reactor, (b) charging oxidation promoter to the system, (c) charging a passivation agent to the reactor at an excessive rate for a period of time sufficient to build up an inventory of active passivation agent in the system, (d) charging additional oxidation promoter to the system at an effective rate to thereby reduce the tendency of the passivation agent to deactivate the oxidation promoter, and (e) reducing the amount of promoter charged to the system to normal upon reducing the rate of addition of passivating agent to normal.

10. A process in accordance with claim 9 wherein the additional oxidation promoter is charged to the system during the period the passivation agent is charged to the reactor at an excessive rate with the charge rate being reduced to normal shortly after the rate of addition of passivating agent is reduced to normal.

11. A process in accordance with claim 9 wherein the additional oxidation promoter is charged to the system shortly before and maintained at said effective rate during the period the passivation agent is charged to the reactor at an excessive rate.

12. A process in accordance with claim 9 further comprising the steps of heating deactivated catalyst in the presence of oxygen in a regeneration zone and wherein said oxidation promoter is charged to said regeneration zone.

13. A process in accordance with claim 9 wherein said passivation agent is an antimony compound.

* * * * *